US005181956A

United States Patent [19]

Chao

[11] Patent Number: 5,181,956

[45] Date of Patent: Jan. 26, 1993

[54] METHOD FOR PURIFYING $TiO_2$ ORE

[75] Inventor: Tze Chao, Newark, Del.

[73] Assignee: E. I. du Pont de Nemours and Company, Wilmington, Del.

[21] Appl. No.: 702,537

[22] Filed: May 20, 1991

Related U.S. Application Data

[63] Continuation-in-part of Ser. No. 613,049, Nov. 15, 1990, which is a continuation-in-part of Ser. No. 490,195, Mar. 8, 1990, abandoned.

[51] Int. Cl.[5] ..... C22B 34/00

[52] U.S. Cl. ..... 75/743

[58] Field of Search ..... 75/743

[56] References Cited

U.S. PATENT DOCUMENTS 2,965,476 12/1960 Rock ..... 75/743

2,992,098 7/1961 Boozenny ..... 75/743

*Primary Examiner*—Peter D. Rosenberg

*Attorney, Agent, or Firm*—Robert B. Stevenson

[57] ABSTRACT

Process for beneficiating titanium bearing ore selected from the group consisting essentially of titaniferous ores, leucoxene, rutile, perovskite, and sphene comprising:

(a) contacting said ore with an aqueous solution of a mineral acid having a concentration of about 3–30 percent by weight said contacting taking place at a temperature of about 160°–300° C., until the desired amount of impurities are solubilized and a leachate is formed, (b) removing the leachate from the product of step (a).

20 Claims, 1 Drawing Sheet

METHOD FOR PURIFYING $TiO_2$ ORE

CROSS-REFERENCE TO RELATED APPLICATION

This is a Continuation-In-Part Application of U.S. patent application Ser. No. 07/613,049 filed Nov. 15, 1990, which is a Continuation-in-Part Application of U.S. patent application Ser. No. 07/490,195 filed Mar. 8, 1990, now abandoned.

BACKGROUND OF THE INVENTION

1. Field of the Invention

This invention relates to an improved method for purifying $TiO_2$ ore which contains numerous impurities including unacceptable levels of naturally occurring radionuclides (NORS) such as thorium and uranium. The purified ore can be used to make $TiO_2$ pigment or titanium metal or be used in any other process where a purified $TiO_2$ ore is required. This invention especially relates to removing impurities from titaniferous ores, leucoxene, rutile, perovskite, sphene, and their derivatives or intermediates such as blow-over in the chloride process.

2. Description of Related Art

Currently, approximately 75 percent of the titanium minerals produced in the world are utilized by the pigments industry to produce $TiO_2$. In the production of $TiO_2$ by the chloride process, beneficiated ore is used which generally contains about 55-96% $TiO_2$. The beneficiation processes are aimed at removing impurities such as alkali metals, alkaline earth metals, rare earth metals, iron, aluminum, silicon, phosphorus, thorium, uranium, chromium, manganese, vanadium, and yttrium. These impurities may be present as oxides, salts, or other complex forms. Especially detrimental to the chloride process are such ores which contain in considerable quantity the impurities of iron, calcium, aluminum, phosphorus, magnesium, barium and strontium, and radionuclides such as thorium and uranium (and their daughters of radioactive decay). For example, phosphorus can cause processing problems in the chloride $TiO_2$ process, and thorium and uranium may concentrate in the $TiO_2$ process and present a potential health hazard. Also, the impurities of aluminum, iron, phosphorus, thorium, and uranium are additionally a problem because they are especially resistant to removal by conventional mechanical or chemical means. Finally, alkaline earth metals can impair fluidization in the $TiO_2$ fluidized bed chlorinator.

Being able to remove such impurities efficiently would be highly desirable because known sources of $TiO_2$ ore not containing such impurities are becoming increasingly scarce and expensive. Moreover, while other processes to purify $TiO_2$ ore are known, it appears that they either require additional, more complex or more expensive processing steps or are deficient in one or more benefits as compared to the process of this invention.

For titaniferous, leucoxene, rutile, perovskite, and sphene ores, impurities which are especially important to reduce to acceptable levels are iron, manganese, calcium, and radionuclides such as thorium and uranium. It is important that iron be reduced to acceptable levels (1) because it often is a major impurity which can cause substantial chlorine consumption in the chloride process for producing $TiO_2$, and (2) it will form iron chlorides in the chloride $TiO_2$ process, and such iron chlorides can be a disposal problem. It also is important that manganese be reduced to acceptable levels. This is because manganese is a high boiling material which can coalesce and form a hard slag on the interior of the flue exiting the fluidized bed chlorinator, which is the first step of the chloride $TiO_2$ process. Note that manganese is commonly associated with titaniferous ores such as ilmenite. Finally, it is important that the radionuclides be reduced to acceptable levels because they can present potential health problems.

In purifying titaniferous ore, leucoxene, rutile, perovskite, and sphene, it is also important that the $TiO_2$ content in the ore be upgraded to a reasonably high level so that output of $TiO_2$ from the $TiO_2$ process is optimized and processing problems associated with removing ore impurities from the process are minimized. Therefore, generally, the $TiO_2$ content in the beneficiated ore should be upgraded to at least 75 percent, preferably to at least 80 percent, and most preferably to at least about 90 percent.

While some prior art processes can remove some of the aforementioned impurities, they typically require prereduction or preoxidation followed by prereduction as an essential step. Prereduction and/or preoxidation is undesirable because it is expensive (due to substantial energy and investment requirements) and tends to make it more difficult to remove radionuclides. It therefore would be desirable to have a beneficiation process which did not require prereduction as an essential step.

The following information is disclosed which may be of interest to this invention:

U.S. Pat. No. 4,176,159 discloses a process for the removal of impurities from rutile, ilmenite, and leucoxene ores. The process requires high temperature calcining, cooling, reducing, cooling, magnetic separation, mineral acid leaching, neutralizing, and washing.

U.S. Pat. No. 4,562,048 discloses the beneficiation of titaniferous ores by leaching with a mineral acid. The temperature used is 120°-150° C., and the pressure used is 10-45 pounds per square inch gauge ("psig"). An essential aspect is the venting of water vapor generated during the leaching process. Prior to leaching, the ore is reduced at about 600°-1100° C.

U.S. Pat. No. 4,321,236 discloses a process for beneficiating titaniferous ore. The process requires preheating the titaniferous ore and a mineral acid prior to the leaching operation. The temperature is maintained at 110°-150° C., and the pressure is maintained at 20-50 psig. For ores containing iron in the ferric state, reductive roasting at about 800°-1100° C. is suggested prior to leaching.

U.S. Pat. No. 4,019,898 discloses the addition of a small amount of sulfuric acid to the leach liquor used to beneficiate ilmenite ore. The temperature used is 100°-150° C., and the pressure used is up to 50 psig. For ores containing iron in the ferric state, the ore is reduced prior to leaching at a temperature of about 700°-1200° C.

U.S. Pat. No. 3,060,002 discloses acid leaching of ilmenite and Sorel slag at temperature of 150°-250° C. Prior to leaching, the ore preferably is roasted oxidatively at about 500°-1000° C.

SUMMARY OF THE INVENTION

Process for reducing the amount of naturally occurring radionuclides such as thorium and uranium and their daughters of radioactive decay in a titanium bearing ore selected from the group consisting essentially of titaniferous ores, leucoxene, rutile, perovskite, sphene, and derivatives thereof, comprising:

(a) contacting said titanium bearing ore, wherein said ore is characterized as containing an unacceptable level of at least one naturally occurring radionuclide selected from the group consisting of thorium and uranium, with an aqueous solution of a mineral acid having an acid concentration of about 3-30 percent by weight, said contacting taking place at a temperature range in excess of 150° C. up to about 300° C., until the desired amount of thorium and uranium are solubilized and a leachate is formed; and thereafter, (b) removing and recovering the remaining ore of reduced level of radionuclide from the leachate.

A preferred process of this invention is as follows:

Process for beneficiating titanium bearing ore selected from the group consisting essentially of titaniferous ores, leucoxene, rutile, perovskite, sphene, and their derivatives comprising:

(a) contacting said titanium bearing ore, wherein said ore is characterized as containing an unacceptable level of at least one naturally occurring radionuclide selected from the group consisting of thorium and uranium, with an aqueous solution of a mineral acid having an acid concentration of about 5-30 percent by weight, said contacting taking place at a temperature of about 160°-300° C. until the desired amount of impurities including thorium and uranium are solubilized and a leachate is formed, and thereafter, (b) removing recovering the remaining ore of reduced level of impurities from the leachate.

There is also provided by this invention $TiO_2$ pigment which is produced by the chloride process from the purified $TiO_2$ ore of this invention.

In accordance with this invention, it has been found that most of the aforementioned impurities in ore (and especially iron, manganese, calcium, aluminum, phosphorus, magnesium, barium, strontium, rare earths, and the radionuclides such as thorium and uranium) can readily be reduced to acceptable levels. Moreover, the process is especially useful for removing impurities which are resistant to conventional removal means, including aluminum, phosphorus, rare earths, thorium, and uranium (and their daughters of radioactive decay) to acceptable levels. Such purified $TiO_2$ ore is especially suitable for making $TiO_2$ pigment by the chloride process. Finally, the process of this invention is highly useful and desirable because it can make practical the utilization of low grade, inexpensive and more abundant $TiO_2$ ore which contains numerous impurities. The process is also simple and requires few steps. Moreover, the process of this invention can have considerably less energy requirements than many prior art processes because a roasting step prior to leaching generally is optional.

Especially important advantages of this invention are its ability (1) to reduce iron, manganese, and naturally occurring radionuclides such as thorium and uranium to acceptable levels, (2) to increase $TiO_2$ content to at least 75% and often to at least 90 percent, and (3) to produce the foregoing benefits without the use of a roasting or prereduction step.

Another especially important advantage of this invention is that it can reduce thorium and uranium to less than about 200 to 250 parts per million ("ppm"), often less than about 150 parts per million, and for some ores less than about 100 parts per million.

BRIEF DESCRIPTION OF THE DRAWING

The Figure represents a plot of the weight percent of metal oxide remaining as a function leach temperature when treating western Australian ilmenite with HCl according to the present invention.

DETAILED DESCRIPTION OF THE INVENTION

Figure 1:
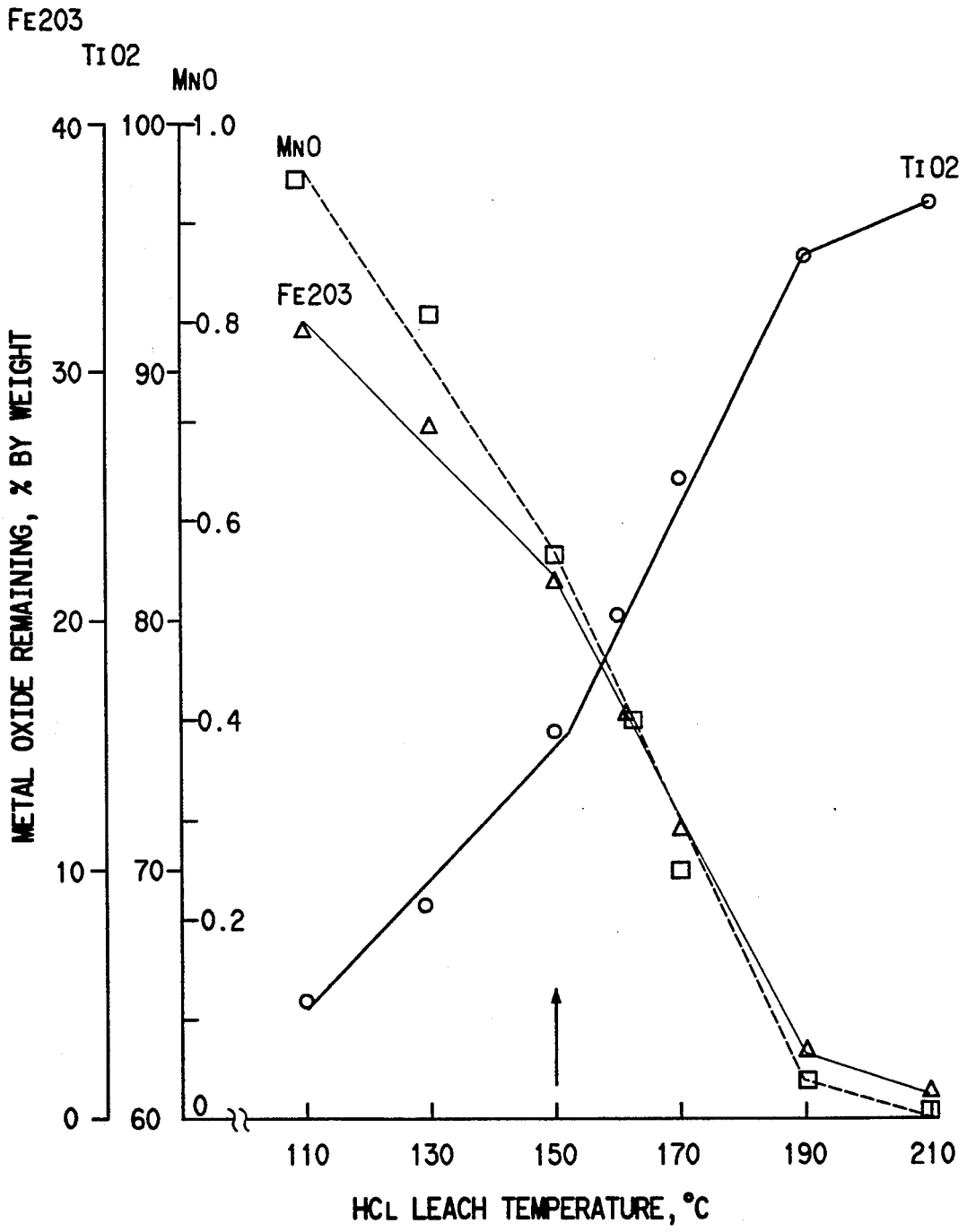

The following sets forth a detailed description of this invention. It should be noted that the process of this invention can be carried out on a batch or continuous basis.

Ore

Ores suitable for use in the process of this invention include titaniferous, rutile, leucoxene, perovskite, and sphene. Preferred are titaniferous, such as ilmenite, titaniferous hematite, and titaniferous magnetite. Especially preferred is ilmenite. As used herein, the term "ore" includes raw ore and beneficiates and derivatives thereof such as slags, blow-over fines from $TiO_2$ chlorinators or other process streams from a $TiO_2$ manufacturing process. The process is especially suitable for further processing of synthetic rutile, i.e., beneficiated ilmenite and chlorination blow-over solids which often have undesirable levels of thorium, uranium and, in the latter case, phosphorus.

Impurities

The impurities which can be removed in accordance with the process of this invention include alkali metals, alkaline earth metals, rare earth metals, iron, aluminum, phosphorous, thorium, uranium, chromium, manganese, vanadium and yttrium. Especially suitable for removal by the process of this invention are the impurities of iron; phosphorus; aluminum; manganese; calcium; barium; strontium; chromium; manganese; vanadium; yttrium; lanthanide elements such as lanthanum, cerium, and neodymium; thorium; and uranium. The impurities of phosphorus, aluminum, iron, calcium, barium, strontium, manganese, and radionuclides such as thorium and uranium are especially detrimental to the chloride process for making $TiO_2$ pigment; such impurities can be readily reduced to acceptable levels by the process of this invention. Also, while the impurities of aluminum, phosphorus, thorium, and uranium are especially resistant to removal by conventional chemical or mechanical means, they can readily be reduced to acceptable levels by the process of this invention. By the term "impurities" is meant the foregoing metals in their elemental state, oxides thereof, salts thereof and other complexes thereof.

An especially important advantage of this invention is its ability to reduce iron, manganese and radionuclides such as thorium and uranium to acceptable levels. This is important because such impurities are commonly associated with titaniferous ores, leucoxene, rutile, perovskite, and sphene.

Particle Size of Ore

For the process of this invention, preferably, the ore should be in particulate form. The optimum particle size for any $TiO_2$ ore desired to be processed can readily be determined by comminuting (such as by grinding, crushing, milling, etc.) the ore into several different particle sizes and evaluating the amount of impurities removed by the process of this invention.

Generally, it can be desirable to liberate the minerals to be separated from the ore, i.e., to comminute the ore into as fine particles as practical so that the presence of discrete minerals or nearly discrete minerals in the particles is improved.

Ordinarily, the ore should have a particle size of less than about one-fourth inch. If ore treated in accordance with this invention is to be used in the chloride process for making $TiO_2$, its particle size can be adjusted so that it is compatible with such process. In such case, the particles preferably will fall within the range of about −20 mesh to +400 mesh. Of course, some ores in their natural state have a particle size within this range. If so, additional comminuting is not necessary.

Mineral Dressing

If desired, the ore can be subjected to mineral dressing prior to the leaching treatments and/or after the leaching treatment. By mineral dressing is meant mechanical processes which can remove some of the undesired impurities, including desliming (removing fine particles by a cyclone, a classifier, grating or settling process), crushing, grinding, classification, screening, flotation, electrostatic separation and magnetic separation. Suitable mineral dressing processes are disclosed in U.S. Pat. No. 4,243,179, which is hereby incorporated by reference. If mineral dressing is used, it can be designed to reduce the ore to the desired particle size in order to satisfy both mineral liberation and $TiO_2$ ore chlorination requirements.

Roasting

Optionally, prior to the leaching process of this invention, the ore can be subjected to reductive roasting. It has been found that such roasting, if carried out under proper conditions, can further reduce the amounts of phosphorus compounds in the ore and lower the temperature needed for the leaching step. The most critical parameter is roasting temperature. If reductive roasting is used, it generally will be carried out at a temperature of about 900°-1600° C., in the presence of a carbonaceous reducing agent. Suitable carbonaceous reducing agents include coke, lignite char, charcoal, coal, lignite, petroleum such as residual oil, carbon monoxide, and natural gas. The roasting should take place under reductive conditions, i.e., in the substantial absence of air or oxygen or under conditions which favor reduction rather than oxidation. A preferred temperature is about 1000°-1500° C. The most preferred temperature is about 1100°-1300° C.

If roasting is used, it can be carried out by any suitable means, process or device. For example, a fixed bed, rotary kiln, fluidized bed, batch or continuous process can be utilized.

The time required for the roasting step can readily be determined by making several experimental trials and selecting those which produce the desired results with the lowest temperature and the least time so that output can be optimized and energy consumption can be minimized. Suitable times often will be in the range of about five minutes to 8 hours, preferably about five minutes to 2 hours, and most preferably about 15 minutes to one hour.

Generally, it has been found that a reductive roasting step is optional, and that usually satisfactory and often excellent results can be obtained without it. A benefit of not using a reductive roasting step is that this can save substantial operating and investment costs. If a reductive roasting step is used, care should be exercised because it has been found that such a step can make the aluminum, thorium, and uranium impurities present in the ore more resistant to removal by the leaching step.

Generally, any oxidative roasting or reductive roasting at less than 900° C. is not desirable, because at such temperatures, in addition to aluminum, thorium and uranium, phosphorus also becomes resistant to removal by the leaching step.

Preleach

If desired, prior to the leaching step, the ore can be subjected to a preleach operation. The purpose of the preleach step is to remove impurities which can be removed with milder conditions than the leaching step described below. Use of the preleach step could enhance the economics of the process and, in some grades of ore, could improve quality.

The acids and concentration of acids described below for the leaching step can be used. Also, if desired, the spent acid from the leach step can be used as the feed for the preleach step. Suitable temperatures are about 50°-100° C., preferably about 60°-90° C. and most preferably 70°-80° C. The pressure ordinarily will be about atmospheric

Leaching

For this step of the process of this invention, suitable acids include hydrochloric acid, sulfuric acid, nitric acid, hydrofluoric acid, and mixtures thereof. Especially preferred are hydrochloric acid, nitric acid, hydrofluoric acid, and mixtures thereof. Most especially preferred is hydrochloric acid.

The acid should be utilized in an effective amount, i.e., an amount and concentration sufficient to solublize substantially the impurities. Analysis of the leachate, i.e., the acid solution containing the dissolved impurities, and the leached ore can readily determine whether or not the amount and/or concentration of acid is sufficient. The acid concentration should be at least 3% by weight, based on the total weight of the solution. Ordinarily, the acid will be present in an amount of about 3-30% by weight, based on the total weight of the solution. Preferably, the concentration of the acid will be about 5-25% and most preferably about 15-25% by weight, based on the total weight of the solution. If sulfuric acid is used, lower concentrations within the foregoing range may be preferable because higher concentrations of sulfuric acid may dissolve undesirable amounts of $TiO_2$.

The acid leaching treatment will take place at a temperature and pressure, and for a time which is sufficient to solubilize substantially the mineral impurities present. Ordinarily, the time required will be at least about 5 minutes. Typical ranges of time are about 10 minutes to four hours, preferably about 10 minutes to two hours and most preferably about 10 minutes to one hour. The temperature should be at least 150° C. The temperature will ordinarily be about 160°-300° C., preferably about 160°-250° C., and most preferably about 170°-210° C. The broadest temperature range is in excess of 150° C. up to about 300° C. An especially preferred temperature range is about 190°-210° C. An especially preferred temperature is about 190° C.

The pressure will generally be autogeneous, i.e., that generated in a closed vessel under the leaching conditions. However, additional pressurization can be added, if desired, which may speed removal of impurities from some ores. Ordinarily, the pressure range will be about 4–100 atmospheres absolute, preferably about 5–75 atmospheres absolute, and most preferably about 10–60 atmospheres absolute. An especially preferred pressure range is about 10–25 atmospheres absolute.

By the term "solubilize substantially," as used to describe the leaching treatment, is meant that the concentration of acid and conditions of temperature, pressure, and time which will solubilize at least about 10% by weight of the total impurities. Preferably, at least 50% of the total impurities will be solubilized. Often, a graph of the concentration of the acid and conditions of temperature and time, compared to the amount of impurities removed will help to determine trends and optimizations.

Removing the Leachate

Following the leaching step and the washing step, if used, the leachate is removed from the treated $TiO_2$ ore. Preferably, this is done by removing the leachate followed by washing with water or by washing with water alone. The leachate can be removed by any suitable means, including filtrating, decanting, centrifuging or use of a hydroclone or a classifier. Preferably, the water will be hot, i.e., up to its boiling point. The amount of washing required can readily be determined by analyzing the wash water for the presence of impurities and acid.

Use of Treated Ore

After the ore has been treated in accordance with the process of this invention, it can be used to make $TiO_2$ pigment or titanium metal or be used in any process where a purified $TiO_2$ ore is desired. Preferably, the $TiO_2$ ore treated by the process of this invention can be used to make $TiO_2$ pigment, and most preferably, to make $TiO_2$ pigment by the chloride process. Suitable chloride processes and reactors for using the $TiO_2$ ore treated in accordance with the process of this invention are disclosed in U.S. Pat. Nos. 2,488,439, 2,488,440, 2,559,638, 3,203,763, 2,833,626, 3,284,159, and 2,653,078, which are hereby incorporated by reference.

EXAMPLE 1

The following example illustrates this invention. Unless otherwise indicated, all percentages are on a weight basis.

Untreated mechanical concentrate of a Western Australian ilmenite was leached hydrothermally under the following conditions:

20% HCL
190° C.
1 hour
gentle agitation
10% pulp density
no thermal pretreatment.

The resultant products, after filtration and washing, shows a high grade $TiO_2$ ore beneficiate which is summarized in Table I. It is important to note that (1) the amount of $Fe_2O_3$ has been reduced from about 33 percent to about 3%, and (2) the naturally occurring radionuclides, thorium and uranium have been reduced from 514 parts per million ("ppm") in the starting ore to less than 44 ppm in the beneficiate.

TABLE I

| Hydrothermal Leach of Western Australian Ilmenite Ore | | |
|---|---|---|
| | Percent Before | Percent After |
| $TiO_2$ | 61.41 | 92.11 |
| $Fe_2O_3$ | 32.81 | 3.03 |
| $Al_2O_3$ | 0.92 | 0.64 |
| CaO | 0 | 0 |
| BaO | 0.08 | 0.04 |
| SrO | 0 | 0 |
| $Cr_2O_3$ | 0.18 | 0.18 |
| MgO | 0.30 | 0.10 |
| $MnO_2$ | 1.00 | 0.03 |
| $Nb_2O_5$ | 0.17 | 0.27 |
| $P_2O_5$ | 0 | 0.17 |
| $SiO_2$ | 1.11 | 1.44 |
| $V_2O_5$ | 0.16 | 0.04 |
| $ZrO_2$ | 0.36 | 0.55 |
| $K_2O$ | 0 | 0 |
| $La_2O_3$ | 0 | 0 |
| $Sc_2O_3$ | 0.02 | 0 |
| $CeO_2$ | 0.07 | 0.02 |
| $Nd_2O_3$ | 0.01 | 0.01 |
| U (ppm) | 22 | less than 20 |
| Th (ppm) | 492 | 24 |

EXAMPLE 2

A mechanical concentrate of a Western Australian ilmenite ore was used as the starting material. The ore was not subjected to any thermal pretreatment. The analysis of this starting material is shown is Table II.

Sixty grams of this ilmenite ore were leached hydrothermally with 200 ml of 20% by weight HCl for 60 minutes in a Tantalum-clad steel bomb. The pulp density was 30 %. A series of individual experiments were carried out at the following reaction temperatures: 110° C., 130° C., 150° C., 160° C., 170° C., 190° C. and 210° C. During the reaction, the bomb was agitated by a rocking action.

The results of the test are shown in Table II and FIG. 1. Note that at 150° C. an inflection point appears, and that above such temperature (1) the $TiO_2$ concentration increases at a faster rate and (2) the concentration of $Fe_2O_3$ and MnO decreases at a faster rate.

TABLE II

| Weight Percent Analysis of Leach of Western Australian Ilmenite Ore | | | | | | | | |
|---|---|---|---|---|---|---|---|---|
| Elem. | Starting Material | 110° C. | 130° C. | 150° C. | 160° C. | 170° C. | 190° C. | 210° C. |
| $TiO_2$ | 60.13 | 64.95 | 68.62 | 75.69 | 80.32 | 85.93 | 94.82 | 97.00 |
| $Fe_2O_3$* | 34.14 | 31.96 | 28.08 | 21.16 | 16.74 | 11.59 | 3.07 | 1.11 |
| $Al_2O_3$ | 0.62 | 0.33 | 0.32 | 0.39 | 0.30 | 0.31 | 0.25 | 0.20 |
| CaO | 0.00 | 0.00 | 0.00 | 0.00 | 0.00 | 0.00 | 0.00 | 0.00 |
| $SiO_2$ | 1.13 | 0.59 | 0.74 | 0.81 | 0.98 | 0.83 | 0.91 | 0.85 |
| BaO | 0.30 | 0.13 | 0.11 | 0.10 | 0.09 | 0.06 | 0.02 | 0.01 |
| SrO | 0.00 | 0.00 | 0.00 | 0.00 | 0.00 | 0.00 | 0.00 | 0.00 |
| $Cr_2O_3$ | 0.23 | 0.24 | 0.25 | 0.26 | 0.24 | 0.25 | 0.21 | 0.17 |
| MgO | 0.40 | 0.20 | 0.20 | 0.10 | 0.10 | 0.10 | 0.00 | 0.00 |
| $MnO_2$ | 1.14 | 0.95 | 0.81 | 0.56 | 0.41 | 0.26 | 0.04 | 0.01 |

TABLE II-continued

| Elem. | Starting Material | Weight Percent Analysis of Leach of Western Australian Ilmenite Ore 110° C. | 130° C. | 150° C. | 160° C. | 170° C. | 190° C. | 210° C. |
|---|---|---|---|---|---|---|---|---|
| $Nb_2O_5$ | 0.19 | 0.19 | 0.20 | 0.22 | 0.23 | 0.25 | 0.28 | 0.29 |
| $P_2O_5$ | 0.03 | 0.03 | 0.03 | 0.03 | 0.05 | 0.03 | 0.03 | 0.03 |
| $ZrO_2$ | 0.22 | 0.24 | 0.27 | 0.28 | 0.28 | 0.30 | 0.31 | 0.31 |
| $Y_2O_3$ | 0.00 | 0.00 | 0.00 | 0.00 | 0.00 | 0.00 | 0.00 | 0.00 |
| $La_2O_3$ | 0.00 | 0.00 | 0.00 | 0.00 | 0.00 | 0.00 | 0.00 | 0.00 |
| $CeO_2$ | 0.01 | 0.01 | 0.01 | 0.00 | 0.01 | 0.01 | 0.01 | 0.00 |
| $Nd_2O_3$ | 0.00 | 0.01 | 0.01 | 0.00 | 0.01 | 0.01 | 0.00 | 0.00 |
| $V_2O_5$ | 0.15 | 0.15 | 0.15 | 0.13 | 0.12 | 0.10 | 0.08 | 0.06 |
| Th (ppm) | 310 | 122 | 76 | 43 | 57 | 51 | 25 | 17 |
| U (ppm) | 22 | 0 | 22 | 20 | 1 | 0 | 2 | 15 |
| % Total | | 98.57 | 99.23 | 98.89 | 99.24 | 99.70 | 99.79 | 99.93 |

*Includes 1.47% FeO

EXAMPLE 3

A fine $TiO_2$ solid derived from the carbochlorination of ilmenite concentrate, called "chlorinator blow-over", was tested by the process of this invention. The chlorinator blow-over was first washed and mineral-dressed to remove the soluble metal chlorides and coke dust. The resultant solid that is rich in $TiO_2$, $SiO_2$, $P_2O_5$, Th and U, was hydrothermally leached with HCl as follows:

Twenty-five grams of coke-free blow-over ore were leached at 180° C. in 250 ml of 20% HCl acid for 60 minutes. After leaching, the ore was separated from the leach liquor by filtration followed by washing with boiling water until the solid was free of residual chlorides and acid.

As shown in Table IV, most of the $P_2O_5$, rare earths Th and U in the starting material were significantly reduced. For this ore blow-over, the reduction of Th and U is especially difficult by conventional means, such as atmospheric HCl leach for prolonged period. In this Example, Th was reduced from 3016 to 188 ppm and U from 158 to 55 ppm, as shown in column A. Column B shows the analysis of the same leached ore after its $SiO_2$ content was reduced by a caustic waste.

TABLE III

| | Hydrothermal HCl Leach of an Ilmenite Derivative from Chlorinator Feed | A | B |
|---|---|---|---|
| $TiO_2$ | 75.09 | 81.94 | 91.23 |
| $Fe_2O_3$ | 0.47 | 0.14 | 0.11 |
| $Al_2O_3$ | 0.64 | 0.50 | 0.52 |
| CaO | 0.09 | 0.03 | 0.01 |
| BaO | 0.07 | 0.00 | 0.07 |
| SrO | 0.00 | 0.01 | 0.01 |
| $Cr_2O_3$ | 0.23 | 0.32 | 0.34 |
| MgO | 0.00 | 0.00 | 0.00 |
| MnO | 0.02 | 0.03 | 0.03 |
| $Nb_2O_5$ | 0.32 | 0.36 | 0.38 |
| $P_2O_5$ | 1.75 | 0.37 | 0.30 |
| $SiO_2$ | 16.81 | 15.16 | 5.20 |
| $ZrO_2$ | 1.33 | 1.48 | 1.47 |
| $Y_2O_3$ | | 0.29 | 0.28 |
| $La_2O_3$ | 0.66 | 0.05 | 0.08 |
| $CeO_2$ | 2.02 | 0.08 | 0.08 |
| $Nd_2O_3$ | 0.72 | 0.00 | 0.03 |
| $V_2O_5$ | 0.11 | 0.10 | 0.12 |
| Th (ppm) | 3016 | 188 | 189 |
| U (ppm) | 158 | 55 | 50 |

EXAMPLE 4

A synthetic rutile derived from a Western Australian ilmenite concentrate still contains a substantial amount of thorium (540-601 ppm). Its uranium content was below the detection limit of the X-ray fluorasce technique (20 ppm). It is desirable to reduce the Th level to near 200 to 250 ppm or below.

Twenty-five grams of the synthetic rutile were leached hydrothermally with a 20% HCl at a pulp density of 10%. After leaching at 190° C. for 60 minutes, the ore was separated from the mother liquor by filtration, and then washed with boiling water. Another sample of this synthetic rutile produced from a different period was leached under the same conditions as described above. The experimental results are shown in Table IV.

TABLE IV

| | Hydrothermal HCl Leach of Synthetic Rutile A (TC-61-85) S.M.* | HTL** | B (TC-82-85) S.M.* | HTL** |
|---|---|---|---|---|
| $TiO_2$ | 91.4 | 96.92 | 90.08 | 96.86 |
| $FeO_2$ | 4.0 | 0.53 | 4.38 | 0.46 |
| $Al_2O_3$ | 1.12 | 0.68 | 1.04 | 0.69 |
| CaO | 0.02 | 0 | 0.02 | 0 |
| BaO | — | 0 | — | 0 |
| SrO | 0.02 | 0.01 | 0.03 | 0.01 |
| $Cr_2O_3$ | 0.15 | 0.14 | 0.16 | 0.14 |
| MgO | 0.4 | 0.1 | 0.3 | 0.1 |
| $MnO_2$ | 0.87 | 0.15 | 0.91 | 0.13 |
| $Nb_2O_5$ | 0.22 | 0.29 | 0.32 | 0.32 |
| $P_2O_5$ | 0.02 | 0.02 | 0.00 | 0.03 |
| $SiO_2$ | 0.89 | 1.02 | 0.86 | 1.02 |
| $V_2O_5$ | 0.27 | 0.14 | 0.19 | 0.12 |
| $ZrO_2$ | 0.25 | 0.13 | 0.27 | 0.13 |
| $La_2O_3$ | — | 0 | — | 0 |
| $CeO_2$ | — | 0.01 | — | 0.00 |
| $Nd_2O_3$ | — | 0.02 | — | 0.01 |
| Th (ppm) | 540 | 186 | 601 | 202 |

*S.M. = Starting Material
**HTL = Hydrothermal HCl-leached Ore

The invention claimed is:

1. Process for reducing the amount of thorium and uranium in a titanium bearing ore selected from the group consisting essentially of titaniferous ores, leucoxene, rutile, perovskite, sphene, and derivatives thereof, comprising:

(a) contacting said titanium bearing ore, wherein said ore is characterized as containing an unacceptable level of radionuclide selected from the group consisting of thorium and uranium of greater than about 250 ppm, with an aqueous solution of a mineral acid having an acid concentration of about 3-30 percent by weight, said contacting taking place at a temperature range in excess of 150° C. up to about 300° C., until the desired amount of thorium and uranium are solubilized and a leachate is formed; and thereafter, (b) removing and recovering the remaining ore of reduced level of radionuclide from the leachate.

2. The process of claim 1 wherein said reduced level of radionuclide in the remaining ore being recovered is less than about 250 ppm.

3. The process of claim 1 wherein the temperature is about 160°-250 ° C.

4. The process of claim 1 wherein the temperature is about 170°-210° C.

5. The process of claim 1 wherein the pressure is about 4-100 atmospheres absolute.

6. The process of claim 1 wherein the pressure is about 5-75 atmospheres.

7. The process of claim 1 wherein the acid concentration is about 5-25 percent by weight.

8. The process of claim 1 wherein the acid is hydrochloric.

9. The process of claim 1 wherein the acid is hydrochloric, the temperature is about 160°-250° C., and the pressure is about 4-100 atmospheres absolute.

10. The process of claim 1 wherein the acid is hydrochloric, the temperature is about 170°-210° C., and the pressure is about 5-75 atmospheres absolute.

11. The process of claim 1 wherein the acid is hydrochloric, the temperature is about 170°-210° C., the pressure is about 10-60 atmospheres absolute, and the acid concentration is about 3-30 percent.

12. The process of claim 1 wherein the acid is hydrochloric, the temperature is about 170°-210° C., the pressure is about 10-100 atmospheres absolute, and the acid concentration is about 5-25 percent.

13. The process of claim 1 wherein prior to contacting with an aqueous solution of a mineral acid the ore is subjected to mineral dressing.

14. The process of claim 1 wherein (a) prior to contacting with the aqueous solution of a mineral acid, the ore is subjected to mineral dressing and optionally a preleach treatment, and (b) optionally, after contacting with an aqueous solution of a mineral acid the ore is subjected to mineral dressing.

15. The process of claim 1 wherein prior to contacting with the aqueous solution of a mineral acid, the ore is subjected to reductive roasting at a temperature of about 900°-1600° C.

16. The process of claim 1 wherein the temperature is about 190°-210° C.

17. The process of claim 1 wherein the temperature is about 190° C.

18. Process of claim 1 wherein prior to contacting with an aqueous solution of a mineral acid the ore is subjected to mineral dressing and the temperature is about 170°-210° C.

19. Process of claim 1 wherein there is no oxidative or reductive roasting prior to step (a).

20. $TiO_2$ pigment produced from beneficiated $TiO_2$ ore from the process of claim 1.

* * * * *